US005411090A

United States Patent [19]

Cornette et al.

[11] Patent Number: 5,411,090

[45] Date of Patent: May 2, 1995

[54] METHOD FOR ISOLATING MULTIPLE GRAVEL PACKED ZONES IN WELLS

[75] Inventors: H. Mitchell Cornette; Stephen E. Morrison, both of Houston, Tex.

[73] Assignee: Atlantic Richfield Company, Los Angeles, Calif.

[21] Appl. No.: 137,870

[22] Filed: Oct. 15, 1993

[51] Int. Cl.[6] ..... E21B 43/04

[52] U.S. Cl. ..... 166/278; 166/51; 166/313

[58] Field of Search ..... 166/278, 51, 313, 276, 166/227

[56] References Cited

U.S. PATENT DOCUMENTS

| | | | |
|---|---|---|---|
| 1,394,192 | 10/1921 | Fitzpatrick | 166/278 |
| 2,597,554 | 5/1952 | West | 166/278 |
| 4,008,763 | 2/1977 | Lowe, Jr. | 166/278 X |
| 5,036,920 | 8/1991 | Cornette et al. | 166/278 |
| 5,078,212 | 1/1992 | Boyle et al. | 166/278 |
| 5,090,478 | 2/1992 | Summers | 166/278 |
| 5,143,606 | 9/1992 | Bernhardt | 166/278 X |
| 5,145,004 | 9/1992 | Cornette | 166/278 |
| 5,163,512 | 11/1992 | Brewer et al. | 166/313 |
| 5,234,055 | 8/1993 | Cornette | 166/278 |

FOREIGN PATENT DOCUMENTS

| | | | |
|---|---|---|---|
| 1460208 | 2/1989 | U.S.S.R. | 166/278 |
| 1488443 | 6/1989 | U.S.S.R. | 166/278 |

*Primary Examiner*—Hoang C. Dang
*Attorney, Agent, or Firm*—Michael E. Martin

[57] ABSTRACT

An auger type gravel pack screen assembly is interposed in a well which is adapted to produce fluids from two spaced-apart zones of interest through gravel packing surrounding the screen assembly. The screen assembly includes a blank pipe section extending through a layer of mixed size gravel of relatively low permeability to prevent the flow of water or gas through the wellbore between the producing zones. The mixed size gravel layer may be placed in the well with a dump type bailer to minimize mixing of the mixed size gravel with a layer of gravel already in the well. The intermediate layer of gravel packing may have its permeability reduced by injecting a settable resin material or the like through a section of the screen assembly which is adapted to provide for injection of such permeability reducing material from a tubing string inserted within the well.

4 Claims, 1 Drawing Sheet

METHOD FOR ISOLATING MULTIPLE GRAVEL PACKED ZONES IN WELLS

BACKGROUND OF THE INVENTION

1. Field of the Invention

This invention pertains to an auger type gravel pack screen assembly adapted to produce fluids from a well in an earth formation from separate and isolated gravel packed zones by installing a substantially impermeable layer of gravel between the zones or by injecting a substance into a layer of gravel between the zones to reduce gravel permeability.

2. Background

Multiple gravel pack type well completions are sometimes desired for producing subterranean fluids from spaced apart zones in an earth formation. U.S. Pat. 5,145,004 to H. Mitchell Cornette and assigned to the assignee of this invention describes one arrangement for producing hydrocarbon fluids from multiple zones utilizing gravel packed wells with auger type gravel pack screens inserted therein. In some applications of gravel packed wells, however, the expense associated with the type of multiple completion described in the '004 patent is not justified or the space between the production zones is too short to utilize the type of apparatus required in the completion arrangement described in the '004 patent.

In certain wells which are capable of producing fluids from multiple spaced-apart zones, intermediate layers of formation material tend to produce water and/or gas which is unwanted when producing crude oil, for example, from the formation zones on each side of the water- or gas-producing zone. Moreover, one or the other of two spaced apart production zones may begin to produce unwanted quantities of water and/or gas. The flow of water and/or gas into an oil production well or water into a gas production well creates several problems such as, in the case of water incursion, requiring artificial lift, development of corrosion of the well structures due to mixing of oil with acidic gases and reduction in the production rate of the desired fluids. Producing gas into a well which is adapted to produce hydrocarbon liquids can also cause similar problems, as well as requiring certain separation and treatment equipment at the surface. Such problems result in lost reserves or require expensive remedial action.

Prior efforts to prevent production of water or gas from an earth formation zone which is intermediate gravel packed oil or gas production zones have not been successful. Plugging of part of the sand control screen or injection of cement to control the water and gas flow have been substantially unsuccessful, particularly when employing so-called auger type gravel pack or sand control screens. However, the present invention overcomes the disadvantages associated with prior efforts to produce fluids from multiple gravel packed zones or zones in which the boundary regions of the zone may be flooded by gas or water. The invention also solves problems associated with efforts to isolate spaced-apart production zones in a gravel packed well, particularly a well which utilizes an auger type gravel pack screen assembly.

SUMMARY OF THE INVENTION

The present invention pertains to a system and method for isolating spaced apart gravel packed zones in an earth formation for producing fluids into a gravel packed well while preventing the production and migration of unwanted fluids into the well.

In accordance with an important aspect of the present invention, an auger type gravel pack screen is arranged to produce fluids into and through the screen from spaced apart zones of an earth formation between which is interposed a zone which is isolated to prevent migration of fluids into the wellbore. An auger type gravel pack screen is provided with an intermediate screen section or blank pipe section adjacent which is placed or created a substantially impermeable gravel packing to prevent the production of unwanted fluids from the zone adjacent to the impermeable gravel packing or to prevent flow of fluids from one of the "production" zones to the other through the impermeable layer of gravel packing.

In accordance with another aspect of the present invention, a multiple zone gravel packed well is provided wherein one or more intermediate layers of gravel packing are placed in the well which are substantially impermeable with respect to the adjacent layers of gravel packing. Still further, the intermediate layer or layers of gravel packing may be rendered substantially impermeable by the injection of a plugging medium such as a polymer type resin which will substantially reduce the gravel permeability.

Still further in accordance with the present invention, a unique auger type gravel pack screen assembly is provided which includes two or more spaced apart screen sections between which is interposed a screen section through which a gravel plugging or permeability reducing medium may be injected into the gravel packing from a tubing string lowered within the screen assembly.

Those skilled in the art will recognize the above-mentioned advantages and features of the invention together with other superior aspects thereof upon reading the detailed description which follows in conjunction with the drawing.

DESCRIPTION OF PREFERRED EMBODIMENTS

Figure 1:
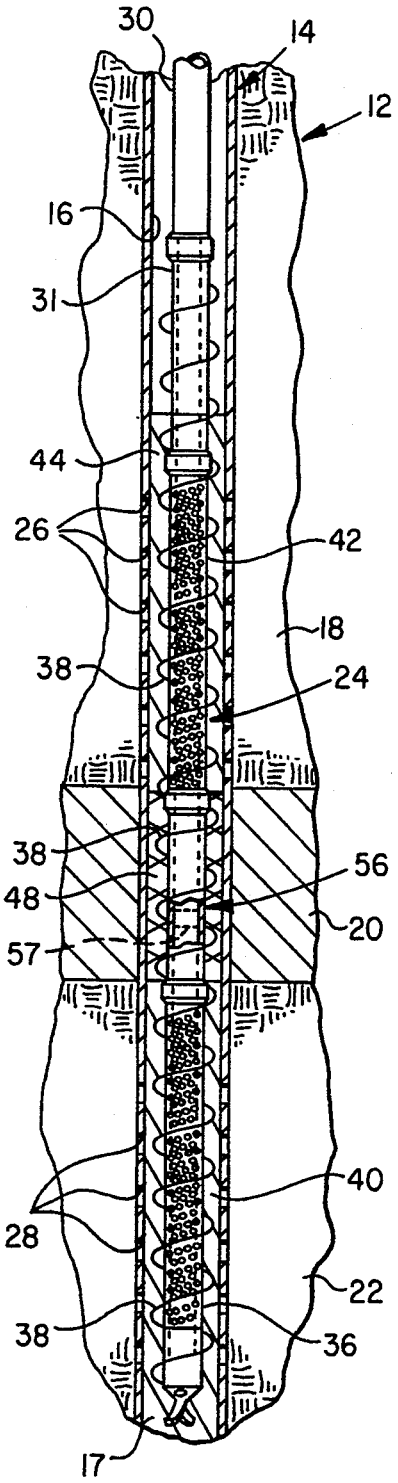
FIG. 1 is a vertical elevation view in somewhat schematic form of a multiple zone gravel packed well completion in accordance with the present invention.

In the description which follows, like parts are marked throughout the specification and drawing with the same reference numerals, respectively. The drawing figures are not necessarily to scale in the interest of clarity and conciseness.

Referring now to FIG. 1, there is illustrated a well completion into an earth formation 12 wherein a well 14, having a casing 16 provided therein, extends through a first oil or gas producing zone 18, an intermediate zone 20 and a second oil or gas producing zone 22. The well 14 is shown wherein a gravel pack type completion has been installed using a gravel pack or sand control screen assembly, generally designated by the numeral 24. As illustrated, the casing 16 is provided with a first set of multiple perforations 26 into the formation zone 18 and a second set of perforations 28 into the zone 22 so that hydrocarbon fluids, for example, may be produced from the zones into the well to flow through the screen assembly 24 and up through a tubing string 30 connected to the screen assembly by way of an auger pipe section 31.

The gravel pack screen assembly 24 is of the so-called auger type similar to that described in U.S. Pat. No. 5,036,920 to H. Mitchell Cornette and assigned to the assignee of this invention, and certain portions of which are commercially available from Baker Hughes Intec, Houston, Tex. The gravel pack screen assembly 24 includes a first screen unit 36 having a continuous auger flight 38 formed thereon and interposed in a gravel packing 40 for controlling the production of solids along with the fluids which flow from the formation zone 22 through the perforations 28 into wellbore 17. The screen assembly 24 includes a second screen unit 42 also having the continuous auger flight 38 formed thereon and disposed in a gravel packing 44 for filtering solids produced from the formation zone 18 through the perforations 26 into the wellbore 17. Some of the perforations 26 and/or 28 may have penetrated the zone 20 which may produce unwanted quantities of water or gas. Moreover, either of the zones 18 or 22 may, at some point in time, begin to produce unwanted quantities of water and/or gas. The zones 18 and 22 may be one continuous "zone" in which it is desired to isolate one part from the other. Accordingly, it is desirable to block the flow of such fluids into the tubing 30.

It is contemplated in accordance with the present invention to provide a layer of gravel 48 between the gravel packing 40 and 44 which is substantially impermeable. The gravel 48 is preferably a mixed size gravel which may, for example, be carried in a viscous fluid into the wellbore and placed on top of the gravel packing 40. The mixed size gravel should have a relatively low permeability, on the order of 1 darcy, which may be obtained, for example, by mixing 50% 100 mesh sand or gravel with 50% of 20 to 40 mesh sand or gravel.

By way of example, a two-foot length annular section of gravel packing 48, placed in a six-inch inside diameter casing with a $3\frac{1}{2}$ inch outside diameter blank pipe section 56 interposed in the screen assembly 24 between the screen units 36 and 42, would require about 300 psi of pressure differential to produce a flow of 20 barrels of water per day. If the permeability of the gravel packing 48 was reduced to 100 millidarcies, the pressure drop required to flow the same amount of water would be on the order of 2800 psi. Accordingly, it is possible to essentially stop the flow of water into and through the wellbore 17 by adjusting the permeability of the gravel packing 48. It may be advantageous to have some permeability in the gravel packing 48 so that a small amount of desired production fluids can pass through. One reason for allowing this to occur is to let gas pass into the wellbore 17 for improved fluid lift efficiency. Another reason for having only a slightly reduced permeability of the gravel 48 is that a very low permeability gravel may adversely affect the ability to auger into the gravel pack with the screen assembly 24.

Moreover, with a mixed size gravel packing 48 interposed between the gravel packings 40 and 44, it may be possible to later on stop fluid production from the zone 22 by installing a plug 57, see FIG. 1, within the blank pipe section 56. The upper zone 18 may also be isolated with a mechanical arrangement such as a coiled tubing string, not shown, packed off in the interior of the screen section 42 above and below the upper zone so that only flow from the lower zone 22 may progress into the screen unit 36, and up through the blank pipe section 56 into the coiled tubing.

A well may be completed in accordance with the arrangement illustrated in FIG. 1 by carrying out the following steps. The lower zone 22 is perforated in a pressure "under-balanced" condition to allow some initial minor fluid flow into the wellbore 17. The perforations 28 are then cleaned by circulating a suitable washing fluid into the wellbore 17. The gravel packing 40 is then placed in the wellbore 17 by a hydraulic fracturing operation or by prepacking the perforations and the wellbore in the area shown in FIG. 1 by filling the wellbore to a point above the perforations penetrating the desired production zone 22. The upper interval or zone 18 is then perforated to form the perforations 26 followed by cleaning out these perforations also.

Mixed size gravel 48 is then placed in the position illustrated in FIG. 1 by suitable means, in accordance with a method which will be described in further detail herein. The mixed size gravel may be carried into the wellbore in a viscous carrier fluid and placed on top of the previously placed gravel 40. This operation may be carried out before the perforations 26 are formed. The gravel pack layer 44 is then put in place as part of a hydraulic fracturing operation for the zone 18 or prepacking the wellbore 17 over the zone of interest 18 with the gravel packing 44. The auger screen assembly 24 is then placed in the wellbore 17 depending from the tubing string 30 or a suitable work string and is augered into the multiple layers of gravel packing to its final point of placement shown in FIG. 1. The screen assembly 24 is proportioned such that the blank pipe section 56 extends across the interval or zone 20. Thanks to the mixed size gravel 48 with relatively low permeability, water or gas will not flow into or within the wellbore 17 through the gravel packing 48 adjacent to the zone 20, or at least such flow will be substantially reduced. Fluids may then be produced up through the tubing string 30 by way of the screen unit 36 and the screen unit 42 each producing fluids from their respective zones 22 and 18.

If the interval between the zones of interest 18 and 22 is sufficiently long, say greater than 50 feet, the mixed size, reduced permeability gravel 48 may not be required. However, in order to prevent production of water or gas from flowing within the wellbore 17 between zones 18 and 22, it is desirable to provide a screen assembly 24 having the blank pipe section 56 which extends over the length of the interval 20. Thanks to the arrangement of the blank pipe section 56 interposed between auger screen units 36 and 42, and the provision of gravel packing 48 which has reduced permeability, or is of sufficient length to reduce or eliminate water or gas flow therethrough, a multiple zone gravel packed well may be completed with a single auger screen assembly without the more complicated and costly multiple gravel pack completions known in the prior art.

Figure 2:
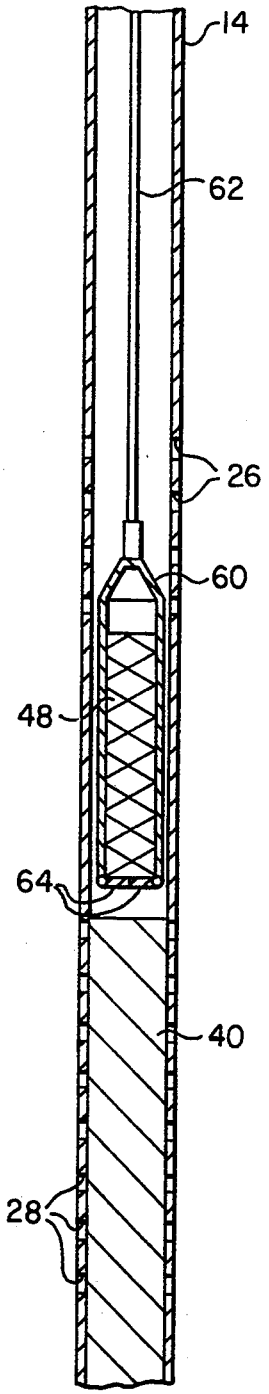
FIG. 2 is a view illustrating one method of installing the intermediate or somewhat impermeable gravel layer.

Referring now to FIG. 2, there is illustrated one method of placing the mixed size gravel 48 in the wellbore 17 to prevent unwanted mixing of this gravel with the gravel packing 40. FIG. 2 shows a dump bailer 60 depending from a conventional wireline 62 and in position just above the top of the gravel packing 40 preparatory to dumping a quantity of mixed size gravel packing 48 into the desired space in the wellbore 17. A suitable bailer 60 may be of a type used for spotting cement materials in wellbores or a modified sand retrieval bailer. The dump bailer 60 includes opposed bottom dump doors 64 which may be suitably actuated by remote control or upon the bailer 60 contacting the gravel packing 40 to release the quantity of gravel packing 48, followed by retrieval of the bailer 60 uphole. The bailer 60 may be similar to or the same as a type manufactured by Cavins Oilwell Tools or Grant Oiltool Company, both of Houston, Tex. Use of a bailer to place the mixed size gravel 48 will substantially prevent separation and mixing of this gravel so that a suitable pack will be placed adjacent the zone or interval 20.

The process of augering the screen assembly 24 into the gravel packing 40, 48, 44 may cause some lifting of the gravel 40 and 48 and commingling or mixing of this gravel with the gravel 44 during the augering process. In order to control the permeability of the gravel packing, whether it be the gravel packing 48 or merely an extension of the gravel packing 40, it may be desirable to carry out the method described hereinbelow.

Figure 3:
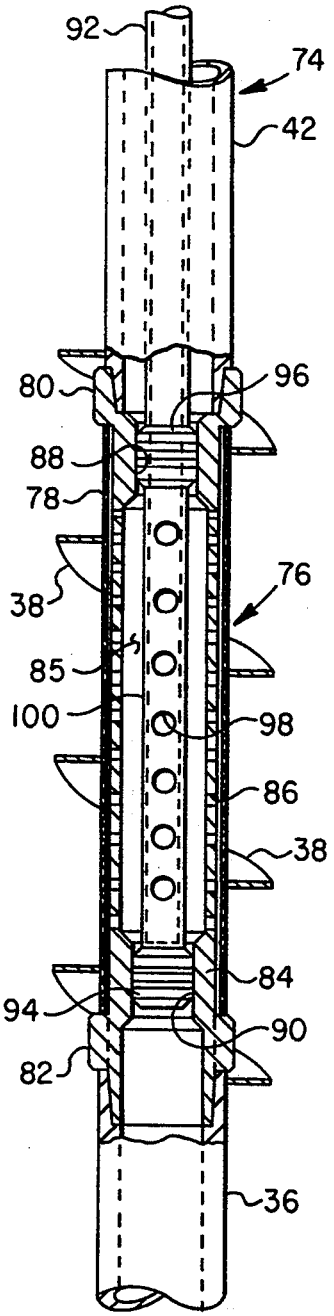
FIG. 3 is a detail view illustrating apparatus used in conjunction with an alternate method of installing the impermeable gravel layer in accordance with the present invention.

Referring to FIG. 3, there is illustrated a modified auger gravel pack screen assembly 74 including the screen units 36 and 42 which have interposed therebetween a screen unit 76 which is threadedly connected to the screen units 36 and 42 in place of the blank pipe section 56, for example. The screen unit 76 also includes a continuous auger flight 38 formed on the outer surface. The screen unit 76 may comprise a perforated tubular liner or screen member 78 secured at its opposite ends to opposed collar portions 80 and 82 such as by welding, not shown. The collar portions 80 and 82 are part of a base pipe member 84 which includes suitable perforations 86 formed therein. Spaced apart seal bores 88 and 90 are formed in the base pipe 84, as illustrated.

As further illustrated in FIG. 3, a tubing string 92 has been inserted within the screen assembly 74 and includes cylindrical seal bosses 94 and 96 having suitable seal means disposed thereon which are adapted to register with the portions of the base pipe forming the seal bores 90 and 88, respectively, to prevent fluid flow into the interiors of the screen units 36 and 42 from an interior space 85 within the base pipe 84. A suitable resin or other sealant may be injected down through the tubing 92 to flow out of ports 98 in a tubing section 100 intermediate the seal bosses 94 and 96 and through the screen unit 76 into the gravel packing which surrounds the screen unit, not shown in FIG. 3, to reduce the permeability of that gravel packing in the interval in which the screen unit 76 is placed which, for example, could be the interval 20 in the formation 12. The resin material injected through the tubing 92, 100 might be a suitable thermal setting resin of a type used in certain wellbore operations. Alternatively, the resin material might be injected by depositing resin on top of a temporary plug inside the screen assembly and then squeezing the resin out into the desired zone.

Once the resin had been injected into the gravel packing surrounding the screen unit 76, the tubing string 92 would be withdrawn and a suitable open-ended tubing string inserted into the interior of the base pipe 84 to flush resin out of the base pipe space 85 and up through the screen assembly 74 and the tubing string 30 to which it would be connected. However, a substantial amount of resin injected into the gravel packing surrounding the screen unit 76 will reduce the permeability of that gravel packing to achieve the same result as desired with placement of the gravel packing 48 in the arrangement illustrated in FIG. 1. The screen assembly 74 may be modified so as to provide a foraminous pipe, such as the base pipe 84, only since the screen assembly will not function as a sand control screen once the resin is injected and set. The screen unit 76 may also have sections of so-called blank or non-foraminous pipe on each end and interposed between the screen unit 76 and the screen units 36 and 42, respectively.

Those skilled in the art will recognize that the above-described systems and methods will substantially control the production of water, gas or unwanted fluids between spaced apart zones in an earth formation which are in flow communication with a gravel pack or sand control screen. Unwanted fluid production may also be prevented from intervals which are interposed between formation zones from which it is desired to produce fluids such as hydrocarbon liquids or gas. Thanks to the arrangement of a continuous auger screen assembly, such as the screen assemblies 24 and 74, multiple zones in an earth formation may be produced through a single auger screen assembly without the more complex arrangements required in prior art multiple gravel pack completions.

Although preferred embodiments of a method and system have been disclosed herein in some detail, those skilled in the art will recognize that certain substitutions and modifications may be made without departing from the scope and spirit of the invention as set forth in the appended claims.

What is claimed is:

1. A method for gravel packing two spaced-apart, fluid-producing subterranean zones within a well while preventing any substantial flow of fluids into said well from between said spaced-apart zones, said method comprising:

depositing gravel in said well to form a first permeable gravel packing adjacent a first of said two spaced-apart zones, said gravel in said first gravel packing being sized to allow flow of fluids from said first zone into said well;

depositing gravel in said well to form a second permeable gravel packing adjacent a second of said two spaced-apart zones, said gravel in said second gravel packing being sized to allow flow of fluids from said second zone into said well;

providing an intermediate, impermeable layer of gravel between said first and said second gravel packings, said intermediate layer preventing any substantial flow of fluids therethrough into said well; and augering a screen assembly through said first and said second gravel packings and said intermediate gravel layer after all of said gravel has been deposited in said well to thereby position a first permeable section of said screen assembly within said first gravel packing and a second permeable section of said screen assembly within said second gravel packing whereby fluids from said first zone will be produced into said first permeable section of said screen assembly and fluids from said second zone will be produced into said second permeable section of said screen assembly.

2. The method of claim 1 wherein said screen assembly includes a blank pipe section which lies within said intermediate layer of gravel after said screen assembly is augered through said first and second gravel packings.

3. The method of claim 2 wherein the step of providing said intermediate layer of gravel comprises:

sizing the gravel therein to prevent any substantial flow of fluids therethrough.

4. The method of claim 2 wherein the step of providing said intermediate layer of gravel comprises:

injecting a sealant into said intermediate layer of gravel to thereby reduce the permeability of said gravel layer.

* * * * *